United States Patent [19]

Smith, III et al.

[11] 4,349,196

[45] Sep. 14, 1982

[54] COMPUTER CONTROL TOY TRACK SYSTEM

[75] Inventors: Jay Smith, III, Pacific Palisades; Thomas G. Schneider, Mar Vista; Thomas H. Grimm, Manhattan Beach, all of Calif.

[73] Assignee: Smith Engineering, Santa Monica, Calif.

[21] Appl. No.: 119,645

[22] Filed: Feb. 8, 1980

[51] Int. Cl.[3] ..... A63B 71/00; A63F 9/14

[52] U.S. Cl. ..... 273/1 GC; 104/88; 104/295; 246/5; 246/247; 273/1 GE; 273/86 B; 273/138 A; 273/153 S; 340/146.3 K; 364/424

[58] Field of Search ..... 104/26 R, 26 B, 88, 104/288, 295, 296; 246/5, 247, 249; 364/424, 426; 340/146.3 K; 273/1 E, 1 C, 1 GE, 86 B, 153 S, 138 A

[56] References Cited

U.S. PATENT DOCUMENTS

| | | | |
|---|---|---|---|
| 2,775,689 | 12/1956 | Pascoe | 104/26 R X |
| 3,016,456 | 1/1962 | Corporon | 104/88 X |
| 3,117,754 | 1/1964 | Morganstern | 104/88 X |
| 3,145,291 | 8/1964 | Brainerd | 104/88 X |
| 3,260,349 | 7/1966 | Vandermeer | 104/88 X |
| 3,277,283 | 10/1966 | Rabinow et al. | 340/106.3 X |
| 3,316,392 | 4/1967 | Bailey et al. | 104/88 X |
| 3,836,768 | 9/1974 | Clarke et al. | 246/5 X |
| 4,089,269 | 5/1978 | Shaw | 104/88 |
| 4,247,107 | 1/1981 | Smith et al. | 104/296 X |

FOREIGN PATENT DOCUMENTS

| | | | |
|---|---|---|---|
| 2031624 | 4/1980 | United Kingdom | 104/295 |

*Primary Examiner*—Randolph A. Reese

*Attorney, Agent, or Firm*—Jackson, Jones & Price

[57] ABSTRACT

A toy track system having an electro-optical sensing device in the roadway senses the passage and identity of a plurality of individual cars on that roadway and provides the sensed information to a microprocessor based operator control panel. The operator control panel provides visual information to the operator by individual LED's and an alpha-numeric display and provides audio information by a speaker. The operator control panel receives information from the operator through a 4×4 matrix keyboard. The microprocessor of the control panel is programmed to permit the operator to test his skill in manipulating the train cars in a dictated sequence and within a certain time frame. The operator can also direct the control panel microprocessor to activate a plurality of accessory devices in the system in a desired sequence and time span.

4 Claims, 16 Drawing Figures

| | | | |
|---|---|---|---|
| SET-UP 1 | ADD CAR 2 | DELETE CAR 3 | NEXT CAR |
| SET SCHEDULE 4 | REQUEST SEQ 5 | VERIFY SEQ 6 | BEGIN DELIVERY |
| ACC. PULSE 7 | ACC. HOLD 8 | ACC. OFF 9 | SOUNDS ON/OFF |
| CLEAR | TIMER START 0 | TIMER DISPLAY STOP | ENTER |

43

COMPUTER CONTROL TOY TRACK SYSTEM

BACKGROUND OF THE INVENTION

1. Field of the Invention

The present invention relates to an amusement system and more particularly pertains to toy track systems such as electric train systems having accessory devices such as railroad crossing gates, drawbridges, etc. that may be remotely controlled. The present invention provides a microprocessor based operator control panel which directs and senses the operator's manipulation of the cars on the track automatically controls or enables the operator's manual control of accessories and allows timing of either or both functions.

2. Description of the Prior Art

In the field of toy track systems, both for the hobby enthusiast as well as the child with his first train set, movement of the locomotive and cars around the oval track soon becomes less than entertaining. In an attempt to create a more interesting and active engagement for the movement of the toy cars, toy manufacturers have devised a variety of animated accessory devices that can be remotely controlled by electrical signals or manually controlled by movement of the train over the track, for example. In addition, toy manufacturers have devised various schemes for moving a particular locomotive and associated cars through a variety of track configurations under the control of the operator.

Although such efforts by toy manufacturers have enhanced the interest of the hobbyist and child in toy electric train systems, once a particular track configuration and environment is established, the operator's function and interaction with the system becomes almost passive and mechanical, thereby again contributing to a lack of entertainment. The present invention stimulates the operator of a train system, no matter how simple or elaborate, by challenging his manipulative and cognitive skills.

OBJECTS AND SUMMARY OF THE INVENTION

An object of this invention is to provide a toy track system wherein the operator's skill in manipulating the cars on the track is tested and acknowledged.

Another object of this invention is to provide a toy track system wherein the operator is required to assemble a dictated sequence of cars within a certain time frame.

A further object of this invention is to provide a toy track system wherein the operator is required to remove individual cars from the train of the cars on the track in a dictated sequence within a certain time frame.

Yet a further object of this invention is to provide a toy track system wherein the operator predetermines the sequence and time frame of operation of a plurality of accessory devices in the system.

These objects and the general purpose of the invention are accomplished as follows. Each of the cars on the track carries an indicia that uniquely identifies it. A sensor in the track roadway detects this identifying indicia as each car passes by it. The sensor provides the information to a microprocessor located in an operator control panel device. The operator control panel provides visual information to the operator by lights and an alpha-numeric display, and provides audio information to the operator by a speaker. The control panel has a multi-key keyboard which the operator uses to make requests and provide information to the microprocessor. The microprocessor is programmed to permit the operator to test his skill in manipulating the cars of the train in a dictated sequence and with a certain time frame. The operator, through the keyboard, can also direct the microprocessor to activate a plurality of accessory devices in a desired sequence and time span.

BRIEF DESCRIPTION OF THE DRAWINGS

These objects and the general purpose of this invention are readily appreciated by reading the following description of the preferred embodiments in conjunction with the attached drawings, wherein.

DESCRIPTION OF THE PREFERRED EMBODIMENTS

A general description of the overall function of the invention will be provided first in order to give the reader a better understanding of the details set forth below. Basically, the invention provides a computerized "dispatcher" function for a toy train system. With the identity of the cars entered into memory, the microprocessor, upon request, scrambles their order and presents the operator with the task of assembling a train of cars in the required order. The microprocessor then checks the operator assembled train to see if it is correctly assembled. The check is accomplished by the elements of the system which read the identifying indicia on the bottom of each car. If the train has been assembled correctly, the microprocessor provides the operator with a signal, a light and a tune, all indicating that the order is either correct or incorrect.

Upon a train being assembled correctly, the operator is then challenged with the task of delivering the train in a certain sequence. The microprocessor prompts the operator to remove a trailing car of the train by displaying its number. The trailing car is removed by moving it to a sliding of the main track, for example. The caboose is then reattached to the previously next to last car. Upon delivering a car, the train is driven across the sensor portion of the track. If the microprocessor senses the absence of the car to be delivered, the delivery is verified as correct. If the wrong car is absent, the microprocessor will indicate the delivery to be incorrect and prompt the operator to deliver the correct car. If the delivery was correct, the microprocessor will indicate a new car for delivery. When all cars on the train have been delivered and only the locomotive and the caboose remain, the microprocessor provides the operator with a signal (a light and a tune) that the delivery is complete.

The microprocessor can receive a time schedule from the operator which challenges the operator to complete a series of tasks like the assembling of a train or delivery of a train within a deadline. The microprocessor indicates to the operator whether he is late in meeting the deadline by lighting a 'late' light on the operator panel.

The microprocessor can be programmed to activate and deactivate up to four separate accessory devices. The microprocessor can simply turn them on or off, or turn them on or off very quickly in a sequence. This can be accomplished immediately upon entering the required information or at a later time in accordance with the timer and the real time clock of the system.

Figure 1:
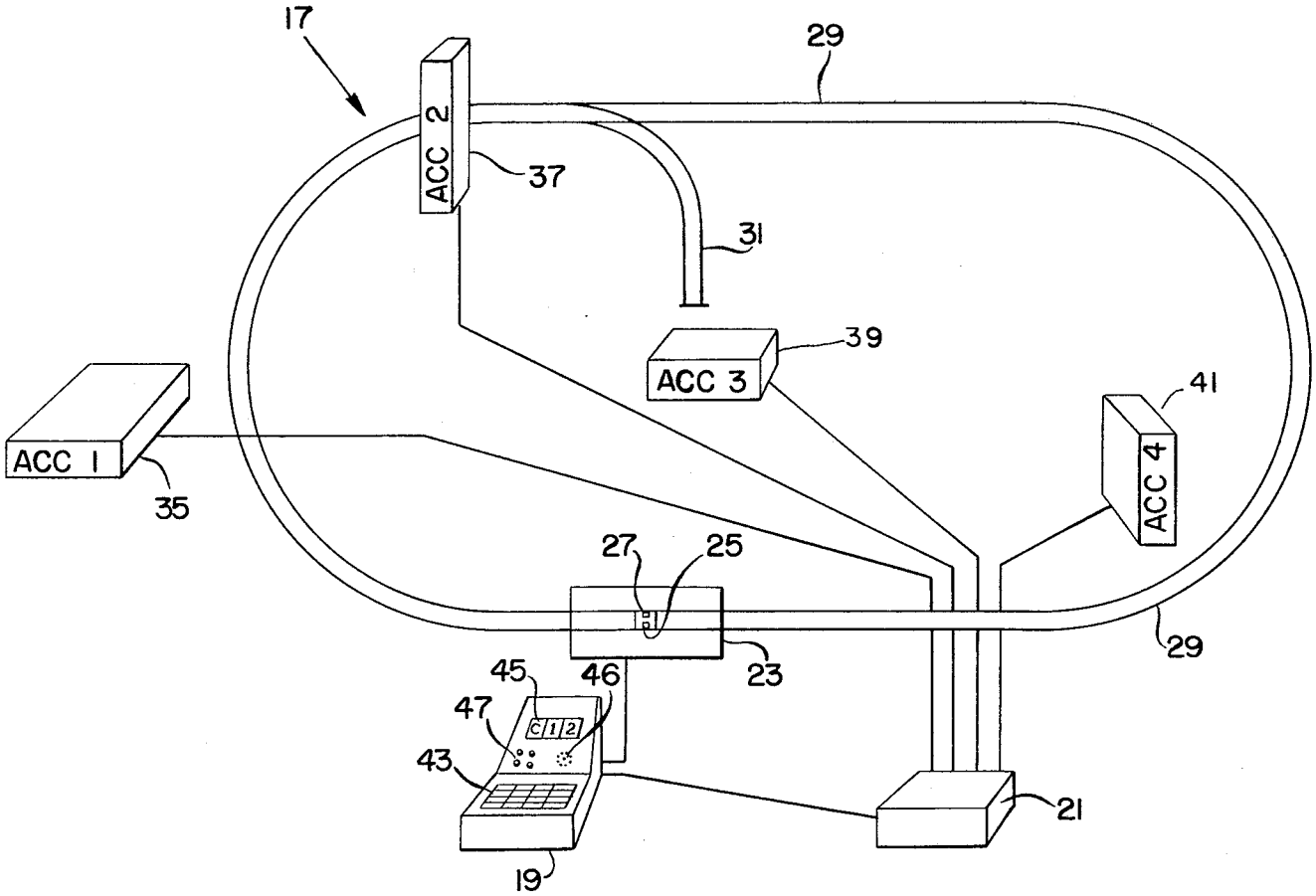
FIG. 1 is a perspective of a toy track layout incorporating the present invention.

Referring now to FIG. 1, which illustrates, in a general way, the elements of the computer controlled toy track system 17, a track 29, having a siding of 31, is illustrated. The other basic and well known elements of a toy electric train system, such as the power pack and operator manipulated controller for moving the train along the track, are not shown. But it should be understood that they are part of the environment of the present invention.

A section of the track loop 29 contains a sensing unit 23. This unit includes a light emitter 25 and a light sensing device 27. Power for driving the sensing unit 23 and signals generated by sensing unit 23 are provided by and supplied to the operator control panel 19, which has a microprocessor therein.

The microprocessor based operator control panel 19 includes a keyboard 43, a plurality of lights 47, a seven-segment display system 45 and a speaker 46.

The operator control panel is connected by electrical wires to an auxiliary accessory control module 21 which contains relay drivers and relays. The auxiliary accessory control module is connected by wires to a plurality of accessory devices, such as accessories numbered 1 to 4, 35, 37, 39 and 41, respectively, which are activated upon the closing of its respective relay in the accessory control module 21. It should be understood that the operator control panel 19 can be utilized in conjunction with the sensing unit 23 without the accessory control module 21.

Figures 2, 3:
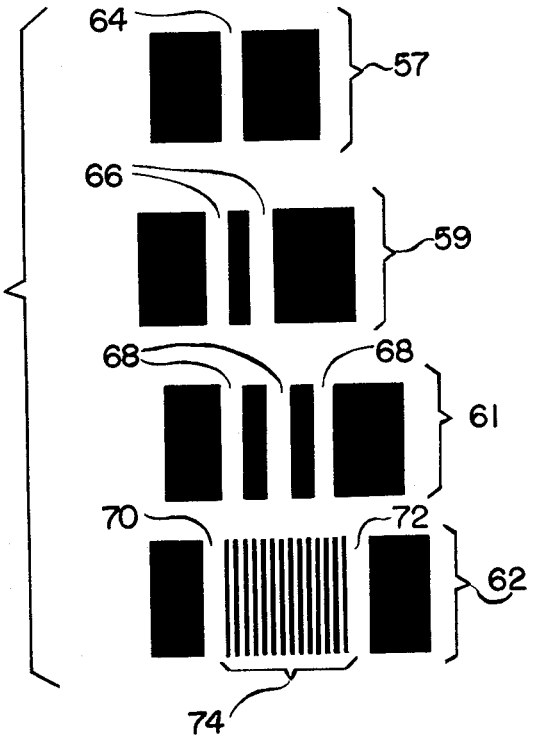
FIG. 2 is a schematic illustration of a preferred embodiment of the keyboard in the operator control panel.
FIG. 3 is an illustration of the stripe bearing decal attached to the under carriage of the cars of the train which uniquely identify each car.

FIG. 2 illustrates a preferred embodiment of the keyboard 43 for the operator control panel 19. The keyboard is preferably a 4×4 matrix having sixteen keys. Some of the keys on the keyboard serve the dual function of generating an instruction, as well as a numerical input. Thus the 'set-up' key also provides the number 1 indicia to the microprocessor. The 'add car' key also provides the number 2. The 'delete car' key also provides the number 3. The 'next car' key only generates an instruction. The 'set schedule' key also provides the number 4. The 'request sequence' key also provides the number 5. The 'verify sequence' key also provides the number 6. The 'begin delivery' key only provides an instruction. The 'accessory pulse' key also provides the number 7. The 'accessory hold' key also provides the number 8. The 'accessory off' key also provides the number 9. The 'sounds on/off' key only provides an instruction. The 'clear' key only provides an instruction. The 'timer-start' key also provides the number 0. The 'timer display/stop' key only provides an instruction. The 'enter' key only provides an instruction. The actions and processes initiated by depression of the various keys on keyboard 43 will be explained more fully hereinafter in conjunction with an explanation of the processes executed by the microprocessor.

Figure 4:
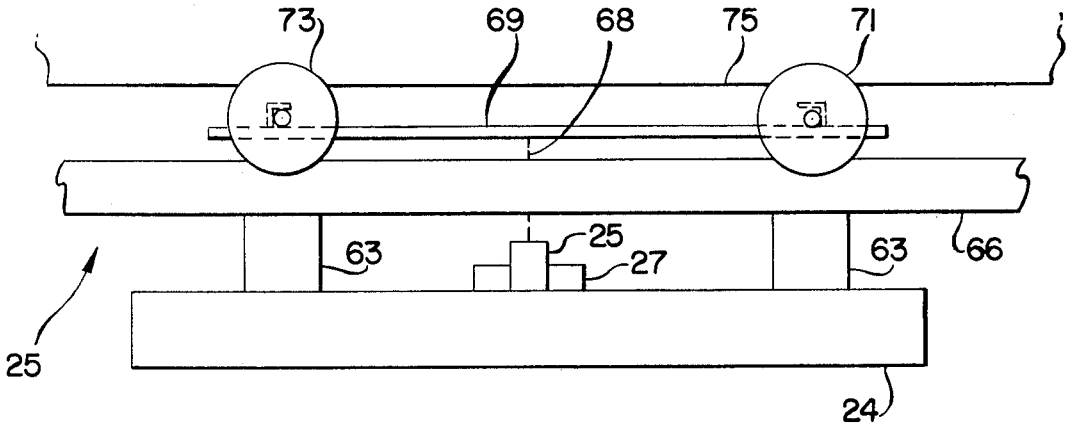
FIG. 4 is a two-dimensional side view, illustrating the relationship between the light emitter, light sensor and reflective identifying indicia stripes attached to the under carriage of the cars.
Figure 5:
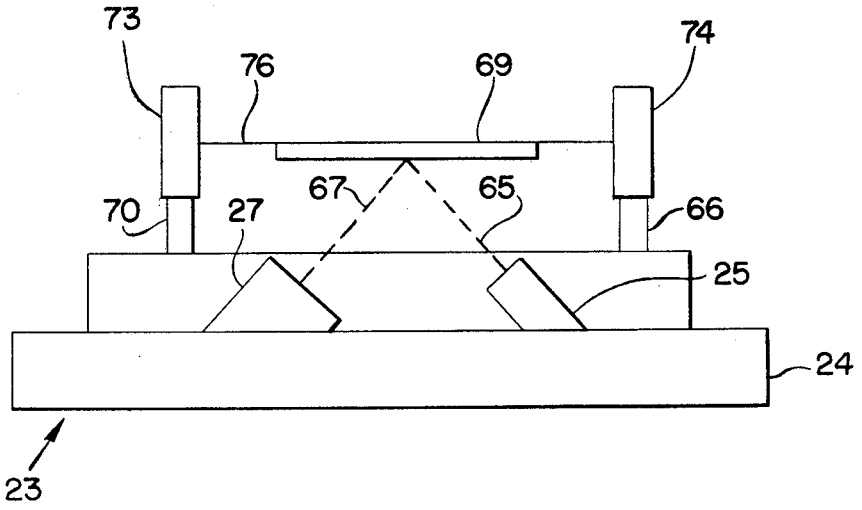
FIG. 5 is a two-dimensional front view, illustrating the relationship between the light emitter, light sensor and reflective identifying indicia stripes attached to the under carriage of the cars.

Turning now to the sense element of the system, which senses the presence of cars at its location, the description will proceed with reference to FIGS. 3, 4 and 5. Basically, two distinct elements must work together to sense the presence and identity of a car at the sensing element 23 of the system. One of the two distinct elements are an indicia element 69, preferably carried under the undercarriage 75 of a car having wheels 73, 71 that ride on rails 66, 70.

The identifying indicia element 69 is preferably removably attached so that it may be interchangeable from car to car.

The preferred manner of accomplishing this result is illustrated in FIGS. 4 and 5. The indicia element 69, as it is moved from car to car, must remain at the same relative distance from the light emitting and sensing elements 25, 27, respectively. The track unit of a toy railroad car is a standard size for all cars of the same scale. By providing for the attachment of the indicia element to the axle of the track unit as shown in FIG. 4, the constant distance required from car to car is assured. The indicia element is preferably a plastic carrier having L-shaped hooks, as shown in phantom that slip over the axle of a track unit for a toy train car.

The identifying indicia element 69 includes a unique arrangement of reflective bars, examples of which are shown in FIG. 3. Each assembly of bars, such as 57, 59, 61 and 62 uniquely identify the car to which it is attached to the operator control panel and specifically, the microprocessor contained therein.

The reflective bar for pattern 57 is identified as bar 64. This pattern represents the number 1. Pattern 59 has bars 66 representing the number 2. Pattern 61 has bars 68 representing the number 3. Pattern 62 has a plurality of bars 74 in between bars 70, 72. The bars 74 represent the number 13. Bars 70 and 72 are attention getting bars for the microprocessor.

The bars on the undercarriage of each car as part of the indicia element are sensed, preferably by an arrangement of a light-emitting diode 25 and a light sensitive photo-transistor 27. The light-emitting diode 25 is preferably emitting light in the infra-red region. This reduces interference from the ambient light. The diode 25 and photo-transistor 27 preferably lie on an axis that is perpendicular to the track 66, 70 which comprises part of the sensing element 23. The light-emitting diode 25 is placed so as to direct its light at an upward angle along the indicated path 65, thereby intercepting the indicia element 69 attached to the car. The light beam is reflected by a reflective bar pattern, such as shown in FIG. 3, of the indicia element 69 at an angle along the indicated path 67 to intercept the photo-transistor 27. The photo-transistor 27 provides electrical signals to the microprocessor in the form of pulses that vary with the reflective bars of each unique bar pattern. Each bar pattern is converted into binary signal notation in a well-known manner so that it may be stored and manipulated by the microprocessor in the operator control panel.

The general construction of the sensing element 23 of FIGS. 4 and 5 may be varied without impairing the sensing function. The preferable embodiment is that shown, wherein the light-emitting element 25 and light sensitive element 27 are located in a support base 24 upon which railroad tie rods 63 are placed to support a track element 65 on which the cars roll past.

Figure 6:
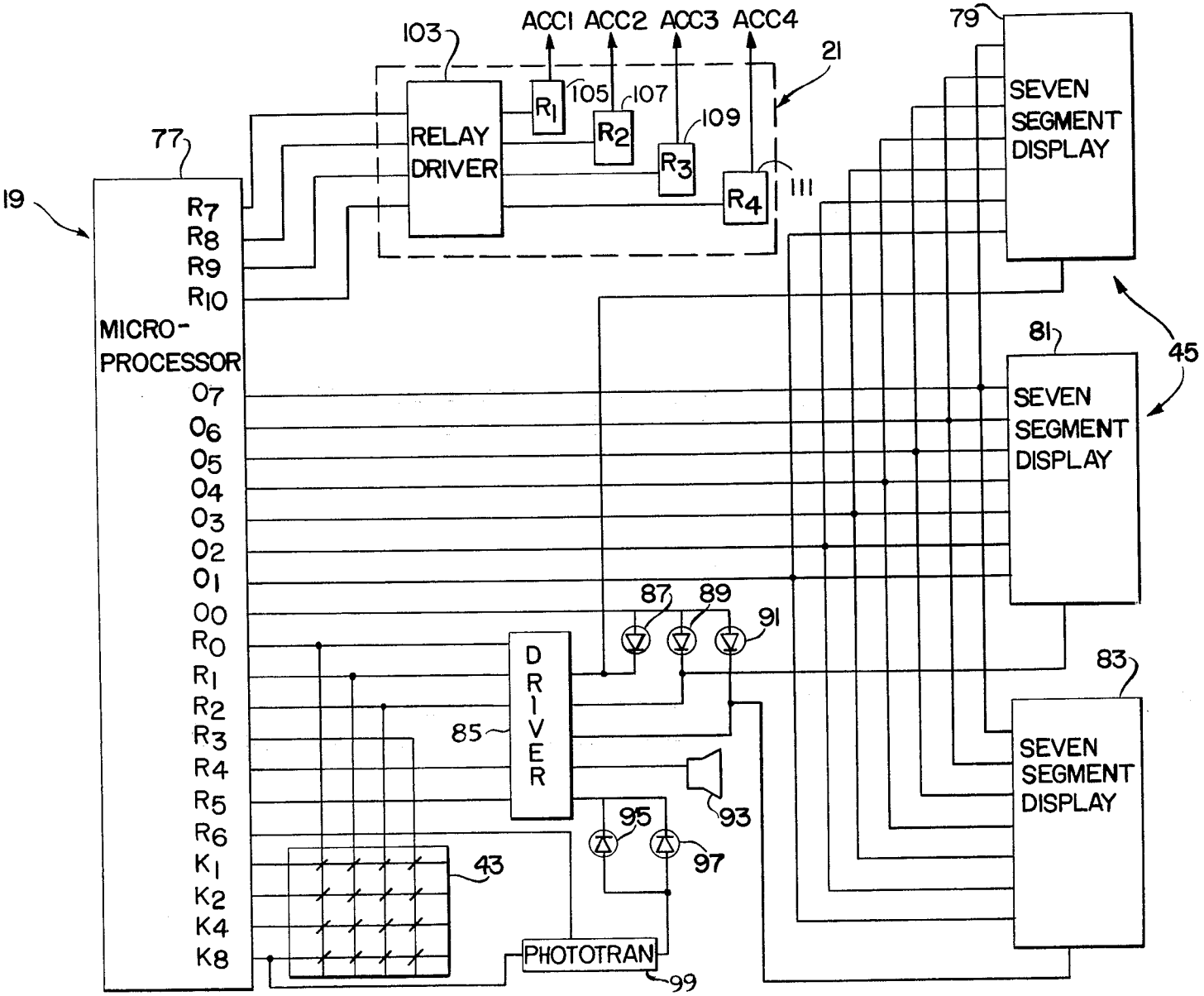
FIG. 6 is a circuit diagram of the microprocessor and its peripheral equipment.

Referring now to FIG. 6, the microprocessor and peripheral electronic equipment comprising the electronics of the present invention as illustrated. The basic element of the system is the microprocessor 77, which is preferably a TMS-1100 microprocessor, a well-known and off-the-shelf item. The clocking and power source circuitry, although not illustrated, is of standard construction. The electronics of the present invention is powered by standard nine-volt batteries. These power cells are not illustrated since their placement with respect to the device they drive is well within the purview of a person of ordinary skill in this art.

The microprocessor has a plurality of input and output terminals. The four output terminals $R_7$ through $R_{10}$ supply signals to the accessory control module 21 and specifically to a relay driver 103 therein. The relay driver may be a 75494 Hex digit driver, a type well-known in the art. The relay driver receives signals over the four input lines from $R_7$ through $R_{10}$ of the microprocessor, and in response thereto, activates relays numbered $R_1$ through $R_4$, 105, 107, 109 and 111, respectively. Relays $R_1$ through $R_4$ are electro-magnetic relays of a type well-known in the art. The closing of the relays causes an associated accessory circuit to be closed thereby activating that accessory.

Microprocessor 77 also has eight output lines $0_1$ to $0_7$ which directly drive the segments of the seven-segment displays 79, 81 and 83. Output $0_0$ drives the 'late' LED 87, the 'correct' LED 89 and the 'incorrect' LED 91.

The display elements 79, 81 and 83 may be LED segment displays such as LITRONIX DATA LIT 10, Monsanto Man 1, for example, or a seven-segment incandescent display such as RCA Numitron DR2000, for example.

Terminals $R_1$ to $R_6$ are output terminals. Terminals $K_1$, $K_2$, $K_4$ and $K_8$ are input terminals. During output, terminals $R_0$, $R_1$, $R_2$, $R_4$ and $R_5$ supply signals to a driver 85 which may be a 75492 Hex digit driver, for example. The driver selectively activates seven-segment display 79, 81 or 83 depending on which line, $R_0$, $R_1$ or $R_2$ provides the driver with a signal.

In addition to activating the seven-segment display, the driver 85 also drives the cathodes of the 'late', 'correct' and 'incorrect' light-emitting diodes 87, 89 and 91. Driver 85, upon command from the microprocessor's output $R_4$, drives the speaker 93 with digital signals that can simulate music or a variety of sounds. This is done by a music algorithm in the microprocessor which is well-known. Output $R_5$ of the microprocessor causes driver 85 to drive the light-emitting diode 97 which is preferably an infra-red LED. In addition, the signals from $R_5$ drive the cathode of the sensor active LED 95.

During the input stages, terminals $R_0$, $R_1$, $R_2$ and $R_3$ output signals to the keyboard column of the $4\times4$ keyboard matrix 43. Terminals $K_1$, $K_2$, $K_4$ and $K_8$ receive the row signals. The intersection of row and column indicates which key is pressed.

Terminal $R_6$ outputs a signal to activate the photo-transistor 99, and $K_8$ receives signals from the photo-transistor 99 which may be a TIL-78 photo-transistor, for example. The photo-transistor, as was explained earlier, is situated with respect to the infra-red light-emitting diode 97 so that light from the LED 97 reflected by the indicia bars on the undercarriage of a car is directed to the photo-transistor 99.

A description of the function of the microprocessor 77 in response to activation and inputs from the sensing element and keyboard of the system will now be provided with reference to FIGS. 7 through 15, which illustrate those procedures in standard flow chart format.

Figure 7:
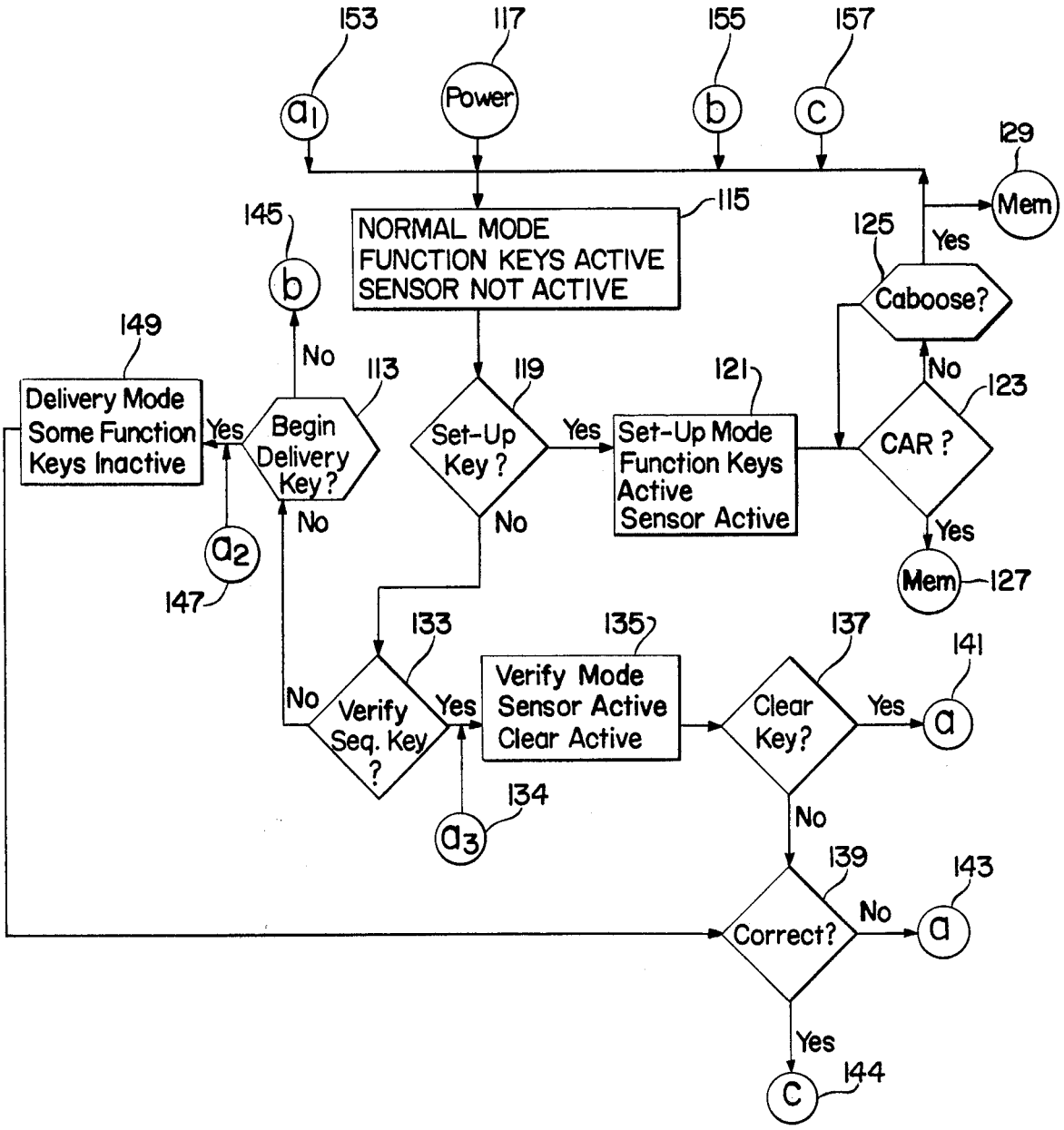
FIG. 7 is a flow chart of the states of the microprocessor according to the present invention.

The computer is programmed to have essentially four modes of operation. The interaction of these modes is illustrated in FIG. 7. Upon the 'power on/off' switch being thrown to 'on', the power 117 comes on, causing the microprocessor to go into its normal mode 115. In the normal mode, all the function keys of the keyboard are active but the sensor element is not. In the normal mode, the microprocessor is awaiting a depression of a function key. Three of these function keys will activate the microprocessor into a different mode.

If a 'set-up' key 119 is depressed, the microprocessor goes into its set-up mode 121. In this mode, all the function keys remain active and the car sensor element also becomes active. If a 'verify sequence' key 133 is depressed, the microprocessor goes into its verify mode 135 where the sensor is active and the clear key also becomes active. If a 'begin delivery' key 113 is depressed, the microprocessor goes into its delivery mode 149 where some of the function keys are active and some are not. The sensor also is active.

Assuming now that the set-up key 119 was depressed and the microprocessor goes into its set-up mode 121, the microprocessor then looks for car indicia either from the sensor or the keyboard. If a car indicia is received, it is stored in memory 127. If a caboose indicia 125 is received, it is stored in memory 129 and the microprocessor goes back into its normal mode 115. Since the caboose is the last car in a train, receiving the caboose indicia indicates that the set-up of the train is complete. The microprocessor then looks for another function key depression. If neither a 'begin delivery' or 'verify sequence' key is depressed at the time, the microprocessor will stay in its normal mode, as indicated by indicia 145–155.

Assuming now that a 'begin-delivery' key 113 was depressed, the microprocessor goes into its delivery mode 149. The procedure followed during this mode will be explained more fully hereinafter. Assuming that the delivery mode is correct 139, the microprocessor then goes back into its normal mode. Illustrated by © 144–157. If the delivery is not correct, the microprocessor stays in the delivery mode 149. Illustrated by 143–147.

Assuming now that a 'verify sequence' key 133 was depressed, the microprocessor goes into its verify mode 135. In this mode, the microprocessor looks for a 'clear' key 137. If a 'clear' key is depressed in the verify mode, the microprocessor goes back into its normal mode as is indicated by indicia 141 and 153. If the 'clear' key 137 had been depressed while the microprocessor was in the delivery mode 149, the microprocessor would have gone back into its delivery mode, as indicated by indicia 141, 147.

In the verify mode, if no 'clear' key is depressed, the microprocessor then looks for correct verification of the train assembly 139. If the verification 139 is correct, the microprocessor goes into its normal mode as indicated by indicia 144, 157. If the verification is not correct, the microprocessor goes back into its delivery mode as indicated by 143, 134.

Figure 8:
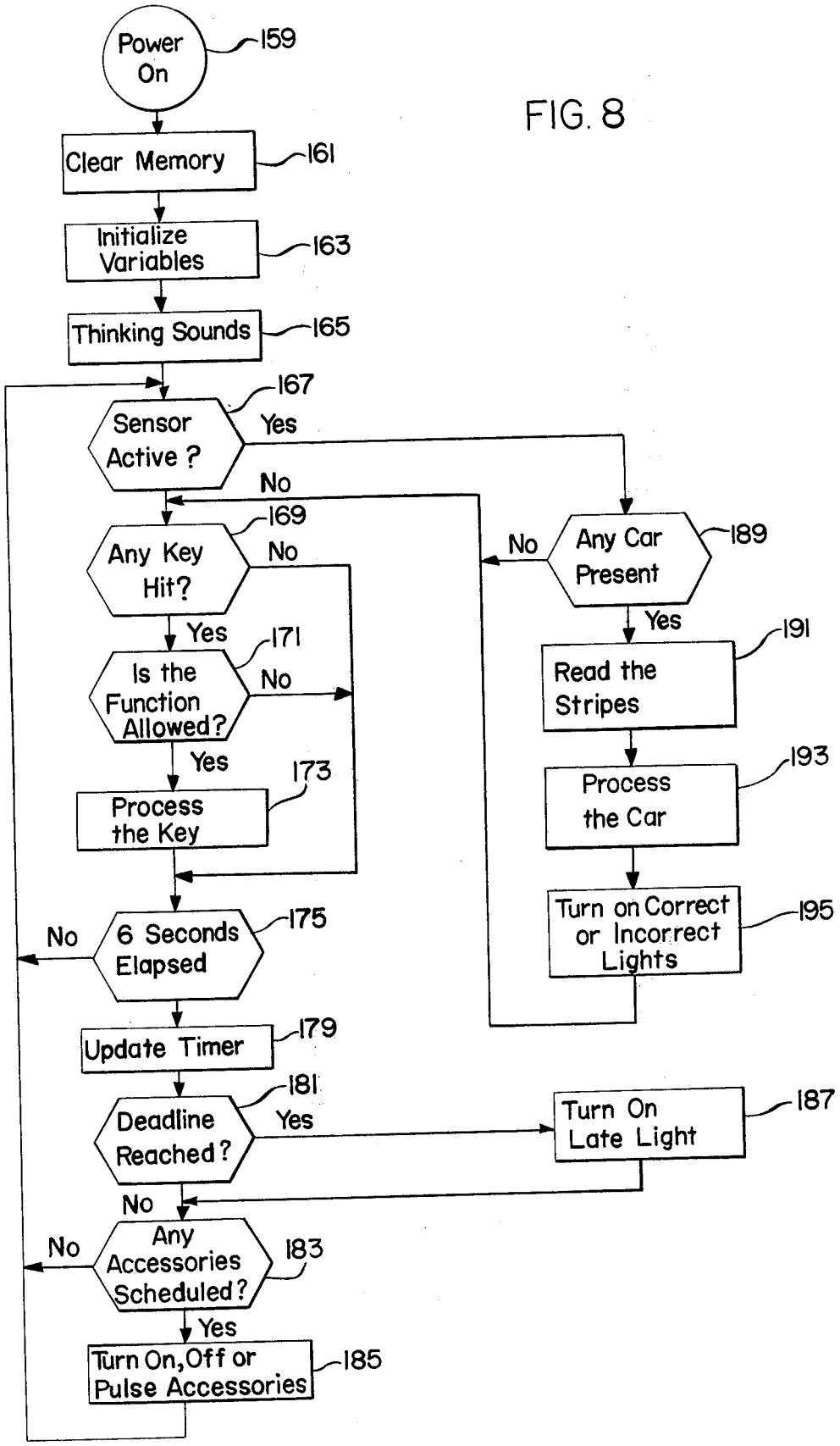
FIG. 8 is a flow chart of the main program structure for the microprocessor according to the present invention.

The overall program structure which governs the operation of the system is illustrated in FIG. 8. When power is turned on 159, the microprocessor performs a 'clear memory' function 161. It initializes the variables 163 and generates 'thinking' sounds 165 to the speaker. Then it determines if the sensor 167 is active. If it is not, it looks for the depression of a function key on the keyboard 169. If a key is depressed, then it checks to see if the function requested 171 by the key is permitted. If it is permitted, it will process that key function 173.

It determines if six seconds have elapsed since power on 175. If six seconds have elapsed, then it updates that timer 179 and checks to see if a set deadline has been reached 181. If it has, it will turn on the 'late' light 187. If it has not, it checks to see if any accessories are scheduled 183. If they have, it will turn on, off or pulse the accessory 185. If no accessories have been scheduled, it again looks for a sensor active indicia 167. If the sensor is active, it checks to see if a car is being sensed 189. If a car is being sensed, it reads the stripe indicia 191 on the car, processes the car indicia 193 by comparing the indicia being read with the car indicia in memory and in response thereto it turns on the 'correct' or 'incorrect' lights 195. Subsequent to that action, it again looks for any key being depressed 169.

Figure 9A:
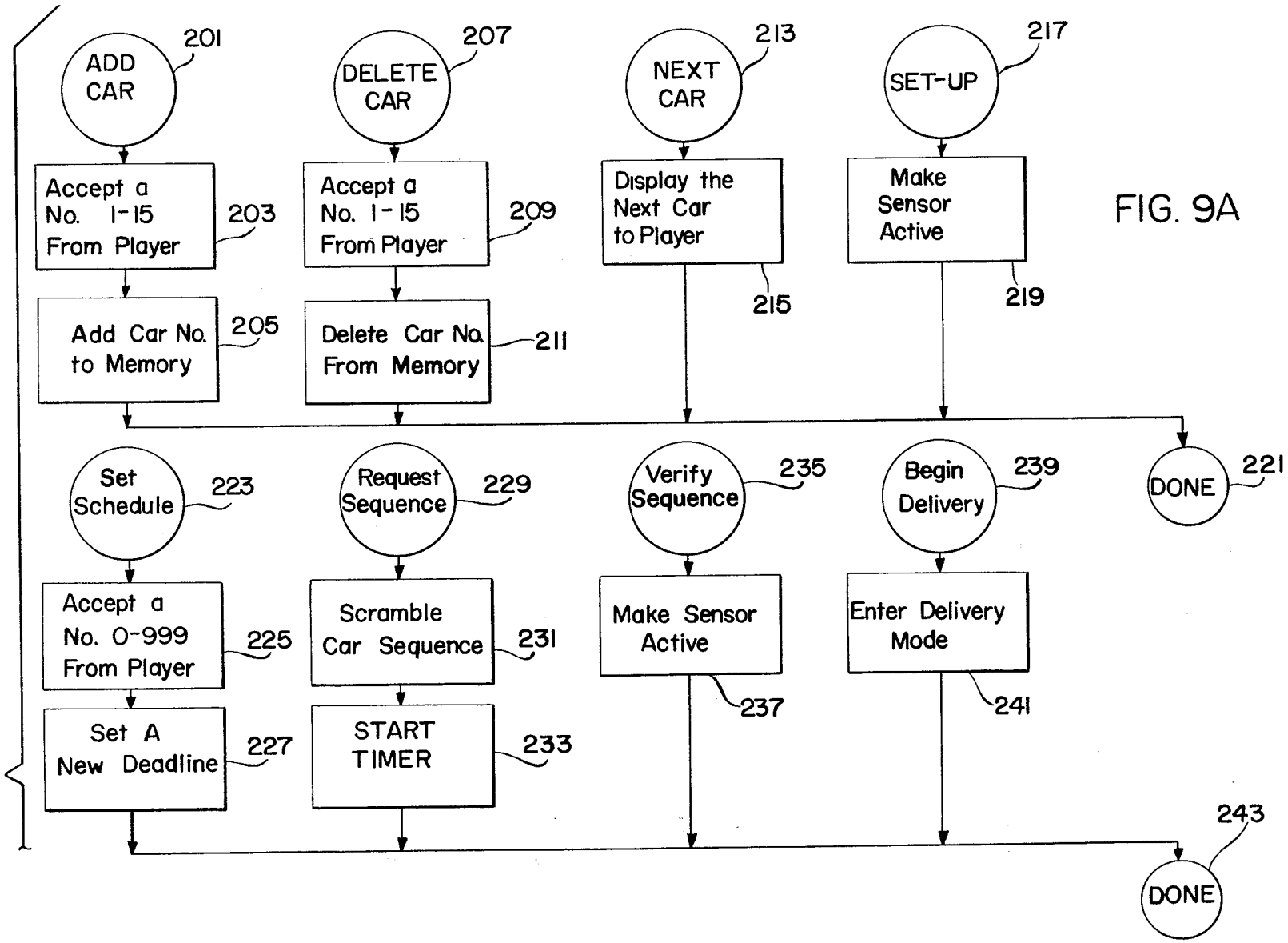
FIGS. 9A and 9B comprise a flow chart describing generally the key functions on the keyboard of the microprocessor based operator control panel.
Figure 9B:
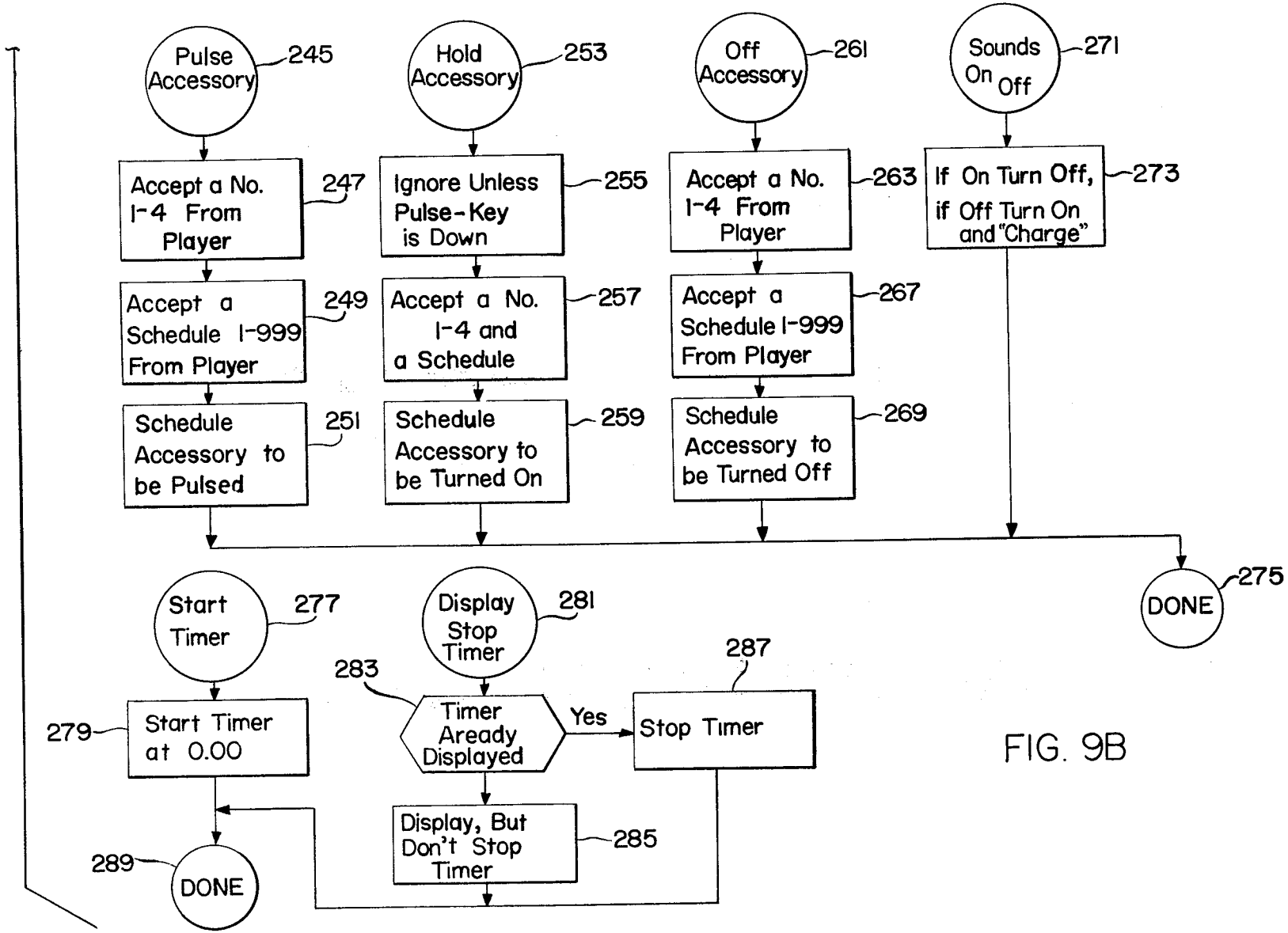

Referring now to FIG. 9, the general operation of the microprocessor in response to the various keys on the keyboard being depressed is illustrated. When the 'add car' key 201 is depressed, the microprocessor will accept a number from 1 to 15, inclusive, from the player 203, either by way of the sensor or keyboard and will add the number indicia of that car to memory 205. That is the end of the process 221. If a 'delete car' key 207 is depressed, the microprocessor will accept a number, 1 to 15 inclusive, from the player 209 and delete the number car indicia from its memory 211. If a 'next car' key 213 is depressed, the microprocessor will display the next car in memory to the player 215. If a 'set-up' key 217 is depressed, the microprocessor will activate the sensor 219.

If a 'set schedule' key 223 is depressed, the microprocessor will accept a number 0 to 999 from the player 225 through the keyboard. The microprocessor will establish this number as the new deadline 227. That is the end of the process 243. If a 'request sequence' button 229 is depressed, the microprocessor will scramble the car indicia stored in memory 231 to provide a new sequence of cars and will start the timer 233. If a 'verify sequence' button 235 is depressed, the microprocessor will activate the sensor 237. If a 'begin delivery' button 239 is depressed, the microprocessor will enter the delivery mode 241.

If a pulse accessory button is depressed 245, the microprocessor will accept a number from 1 to 4, inclusive, from the player by way of the keyboard 247 and, if entered, will accept a schedule for each of the number buttons depressed, which can be any number from 0 to 999, from the player by way of the keyboard 249. The microprocessor will then schedule the accessory to be activated 251. That is the end of the process 275. If a 'hold accessory' button 253 is depressed, the microprocessor will ignore it unless the pulse accessory button is also down 255. If it is, the microprocessor will accept a number 1 to 4 and a schedule from the keyboard 257. The microprocessor will then schedule the accessory to be turned on 259. If an 'off accessory' button is depressed 261, the microprocessor will accept a number 1 to 4 from the player 263 by way of the keyboard. It will accept a number between 0 and 999, from the player by way of the keyboard 267. It will schedule the accessory to be turned off 269. If a 'sounds on/off' button 271 is depressed, the microprocessor will turn the sound off if it is presently on and if it is presently off, it will turn it on and play the tune "Charge."

If the 'start timer' button 277 is depressed, the microprocessor will start the timer at 00.0, 279. That is the end of the process 289. If a 'display/stop timer' button 281 is depressed, the microprocessor checks to see if the time of the timer is already being displayed. If it is, it will stop the timer 287. If it is not, it will display the time but will not stop the timer 285.

With this general description of the function of the buttons on the system keyboard, the more detailed flow charts illustrating the more important processes of the microprocessor can now be more readily understood and will therefore now be explained.

Figure 10:
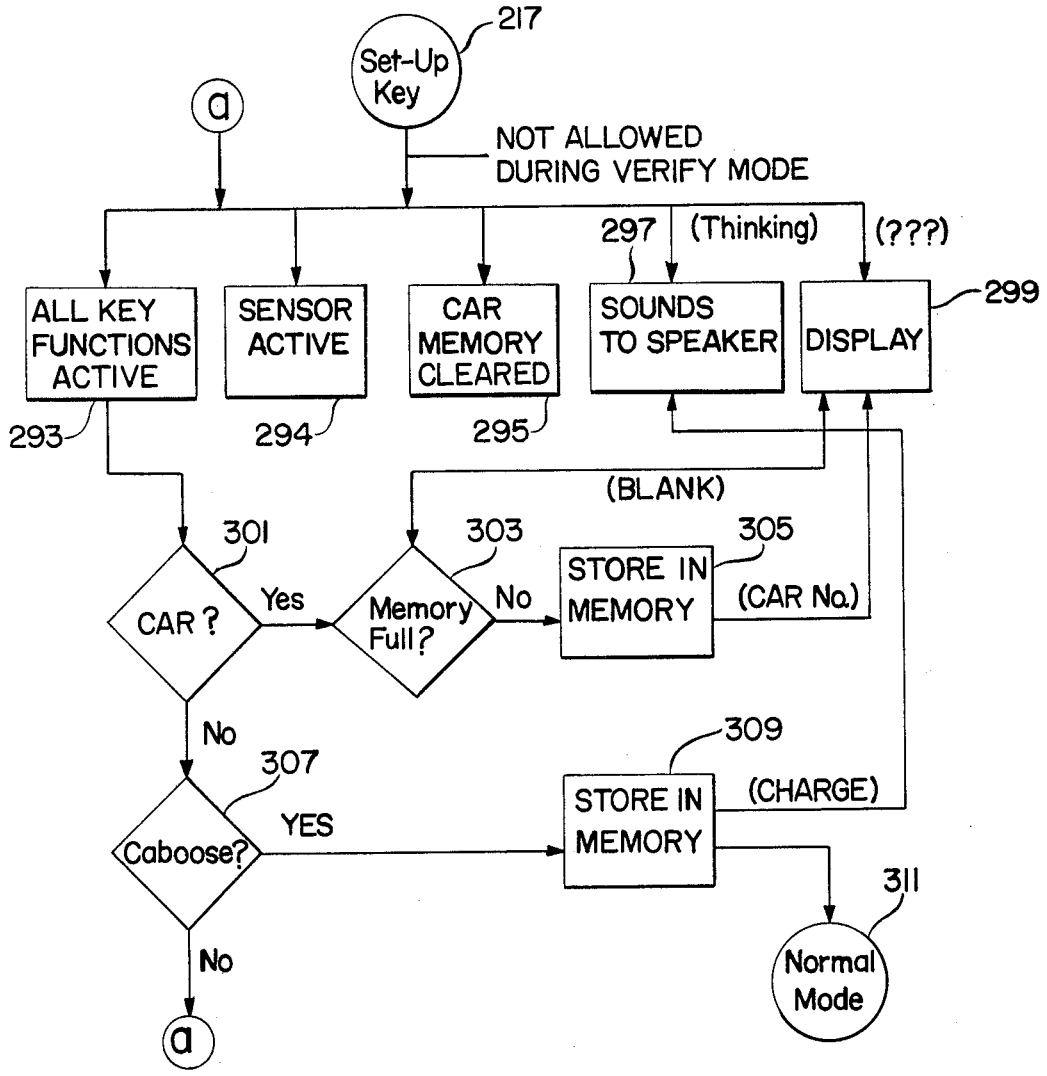
FIG. 10 is a flow chart of the procedure executed when the 'set-up' key on the operator control panel is pressed.

Referring first to FIG. 10, the function of the microprocessor in response to a 'set-up' key is illustrated. The 'set-up' key 217 is not permitted during the verify mode and will therefore produce no response if the microprocessor is in the verify mode. But, during the normal mode, the microprocessor responds to the 'set-up' key by making all key functions active 293, activating the sensor 294, clearing the car memory 295, generating thinking sound 297 and displaying ??? on the seven-segment display 299.

The microprocessor then looks for a car indicia 301, either from the keyboard or the sensor. If a car indicia is received, it checks to see if memory is full 303. If memory is full, the microprocessor generates a blank display 299. If memory is not full, the microprocessor stores the car indicia in memory 305 and displays the car number being stored.

If a car indicia is not entered 301 but rather a caboose indicia 307 is entered, either by way of the sensor or the keyboard, the microprocessor causes the caboose indicia to be stored in memory 309 and a "Charge" tune is generated to the speaker 297 and the microprocessor returns to its normal mode 311. If neither a car indicia 301 or caboose indicia 307 is provided after the set-up key 217 is depressed then the microprocessor stays in the set-up mode.

Figure 11:
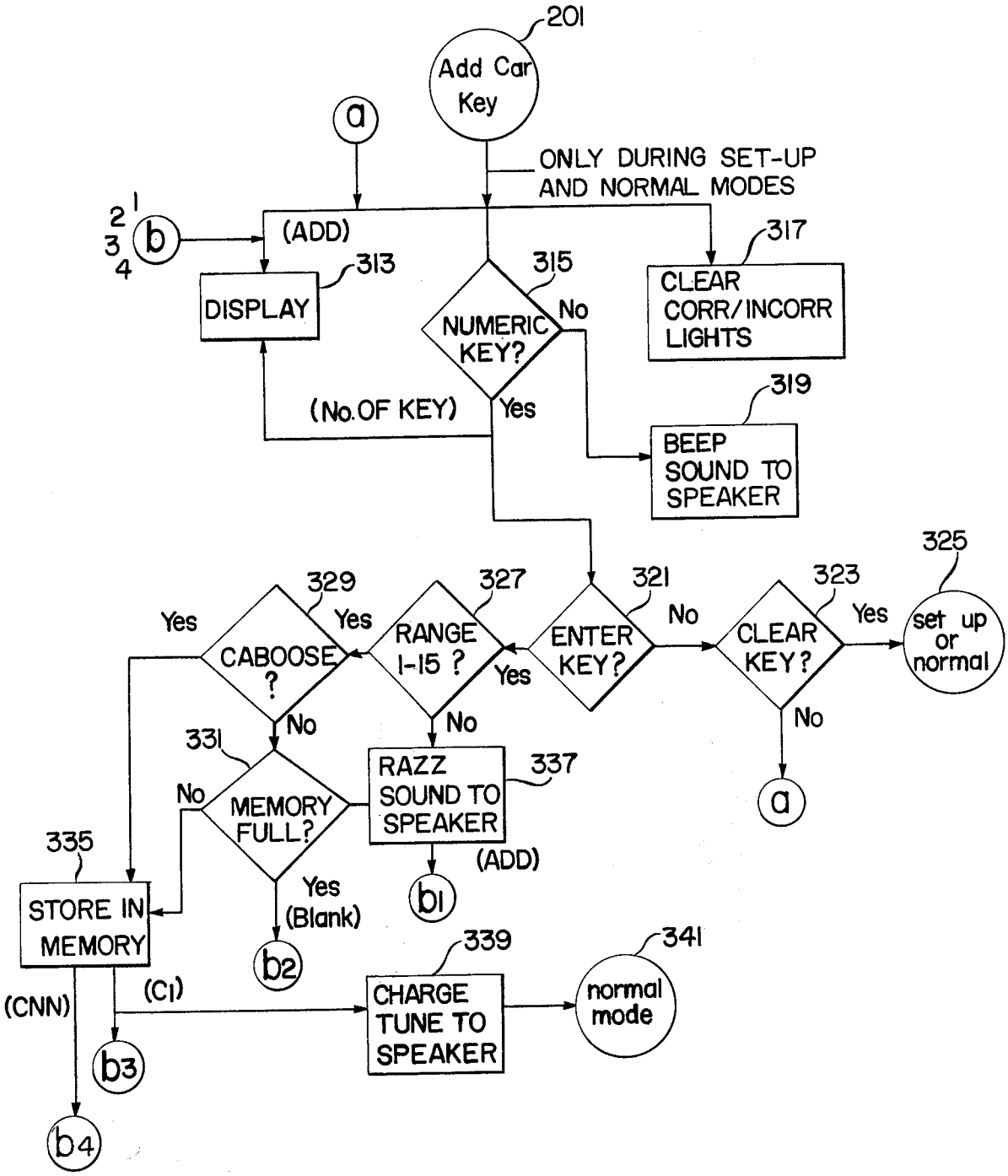
FIG. 11 is a flow chart illustrating the procedure executed when the 'add car' key on the operator control panel is depressed.

Referring now to FIG. 11, assume that 'add car' key 201 was depressed. This key is sensed only during the set-up and normal modes. If the microprocessor is in a delivery or verify mode, this key is not sensed. Assuming that the microprocessor is in its set-up or normal mode, upon sensing the 'add car' key 201, it will cause the word 'add' to be displayed 313. It will look for a numeric key depression 315 and it will clear the 'correct' and 'incorrect' lights if they are lit 317. If a numeric key is depressed, then the depressed key number is displayed 313. If no numeric key is depressed, but some other key is depressed, there will be a 'beep' sound to the speaker 319 but no other action taken by the microprocessor.

If, however, an 'enter' key is depressed 321, the microprocessor checks 327 to see if the number entered by the keyboard is in the range 1 to 15. If it is, it checks 329 to see if the number entered is the caboose. If it is, it stores the caboose in memory 335 and displays that number in the format $C_1$, and causes a "Charge" tune to be delivered to the speaker 339. The microprocessor then goes into its normal mode 341. If it is not the caboose, the microprocessor checks to see if the memory is full. If the memory is full, it will display a blank 313. If the memory is not full, it will store the number entered in memory 335 and display that number in the format CNN, where NN is a two-digit number.

If, after a numeric key 315 is depressed, an 'enter' key 321 is not depressed, the microprocessor checks to see if it is a 'clear' key 323. If it is a 'clear' key, the microprocessor goes back to its set-up or normal mode depending upon whether it was in the set-up or normal mode when the 'add car' key 201 was depressed. If a 'clear' key 323 was not depressed, but some other key was depressed, then the microprocessor starts the procedure over again by looking for a numeric key 315.

Figure 12:
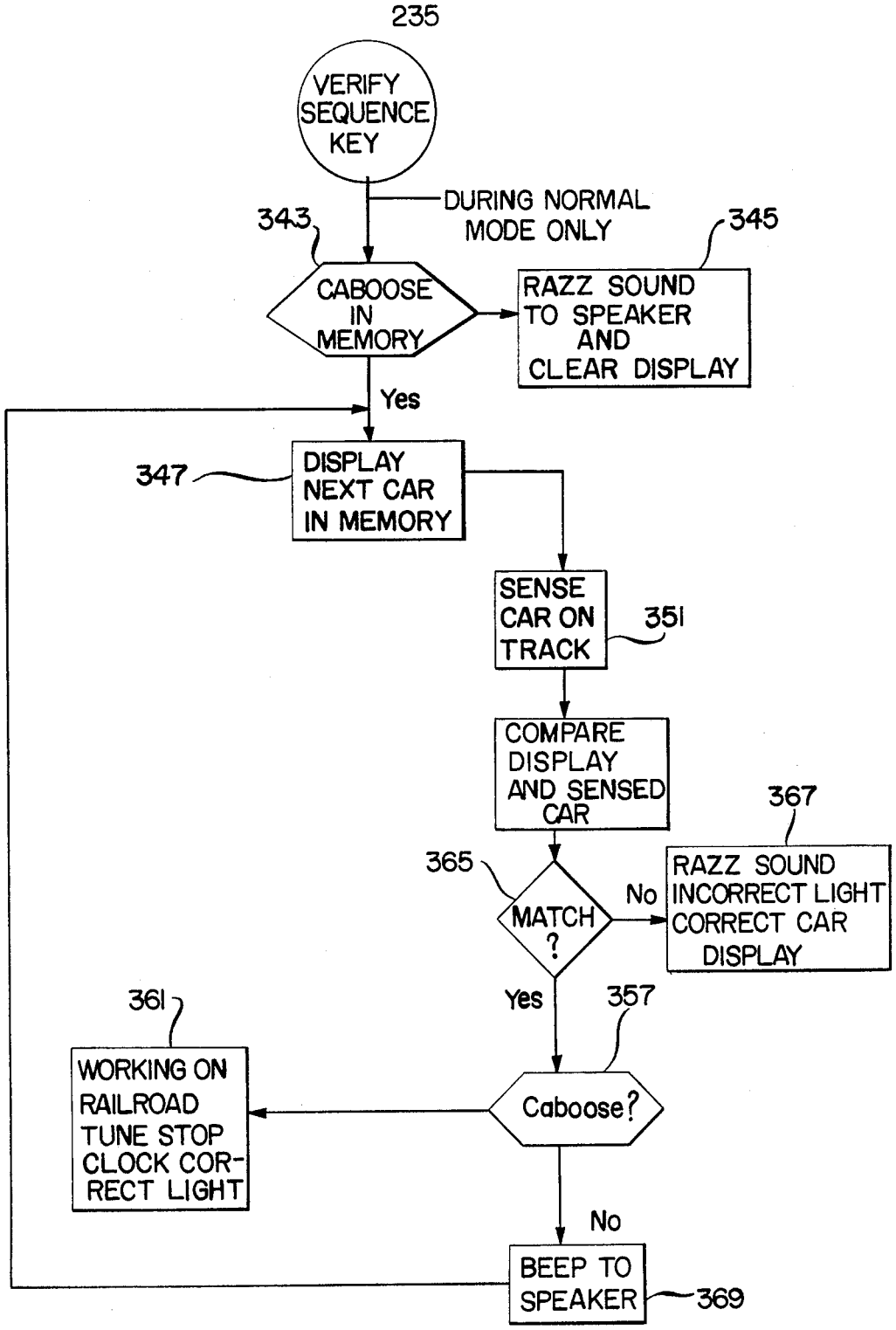
FIG. 12 is a flow chart illustrating the procedure executed when the 'verify sequence' key on the operator control panel is depressed.

Referring now to FIG. 12, 'verify sequence' key functions 235 is illustrated. The microprocessor recognizes it only if it is in the normal mode. If that is the case, the microprocessor looks for a caboose indicia in memory 343. If it does not find a caboose in memory, the set-up procedure has not been completed and the microprocessor generates a 'razz' sound to the speaker and clears the display 345. If a caboose is found in memory, then the microprocessor displays the next car in memory in the sequence 347, senses the car on the track at the sensor location 351, compares the display and the sensed car 363, determines if a match has occurred 365. If no match has occurred, it generates a 'razz' sound to the speaker, lights the 'incorrect' light and displays the correct car to be provided to the sensor 367. If a match is indicated 365, the microprocessor checks to see if the displayed car and the sense car is a caboose 357. If it is not, it generates a 'beep' to the speaker 369 and displays the next car in memory. If it is a caboose, the microprocessor provides a "Working On The Railroad" tune to the speaker, stops the clock and lights the 'correct' light 361.

Figure 13:
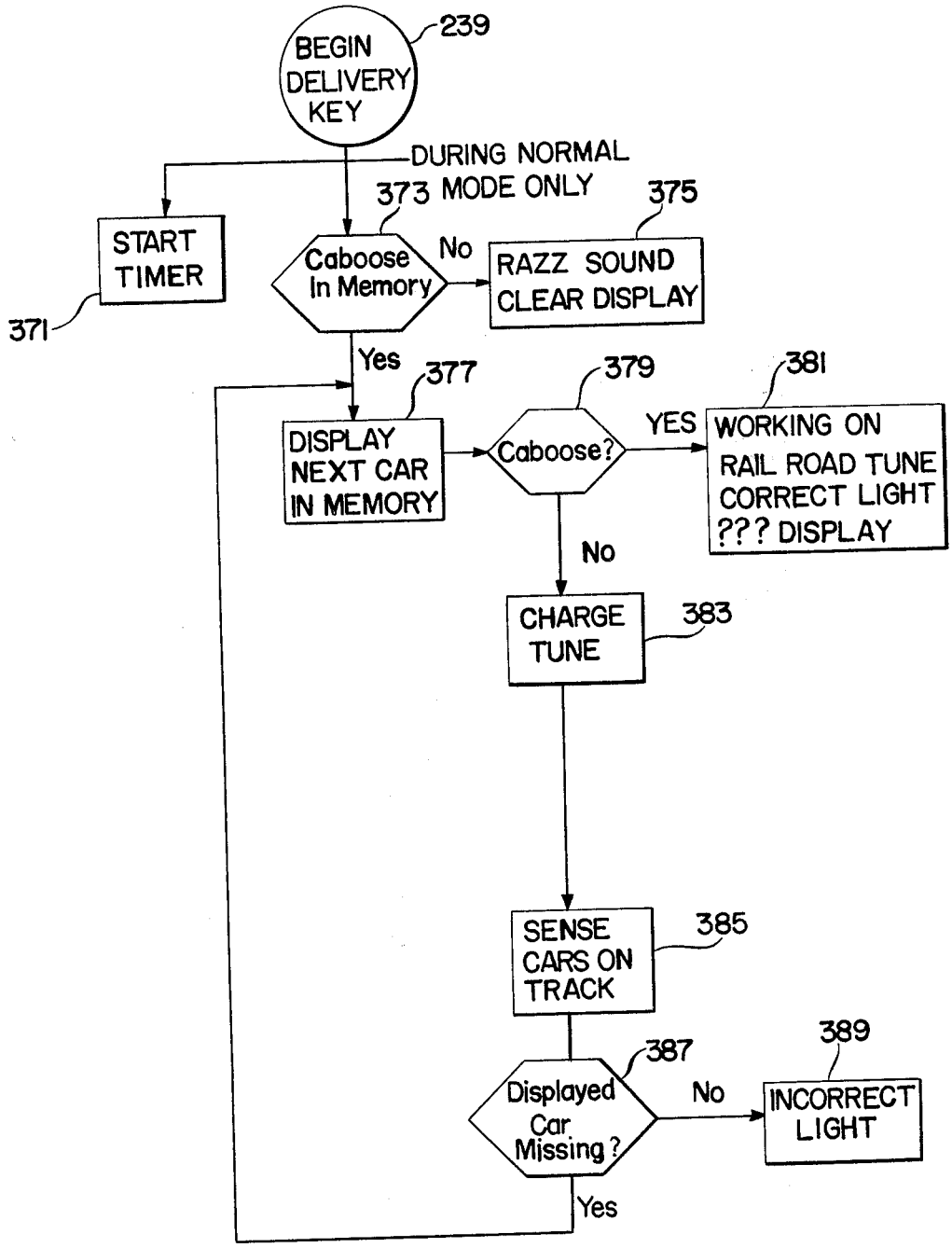
FIG. 13 is a flow chart illustrating the procedure executed when the 'begin delivery' key on the operator control panel is depressed.

Referring now to FIG. 13, the delivery procedure is illustrated. When the 'begin delivery' key 239 is depressed, the microprocessor will take notice of it only if it is in the normal mode. Assuming the microprocessor is in the normal mode, it would start the timer 371 and determine if a caboose indicia is in memory 373. If a caboose indicia is not in memory, it would generate a 'razz' sound to the speaker and clear the display 375. If a caboose indicia was in memory, it would cause a display of the next car in memory 377. If the next car displayed was a caboose 379, the microprocessor would generate a "Working On The Railroad" tune, light the 'correct' light and display three question marks 381. If the car being displayed was not a caboose, it would generate a "Charge" tune to the speaker 383, sense the cars passing over the sensor 385 and determine if the displayed car was missing 387. If it was not missing, it would light the 'incorrect' light 389. If it was missing, the microprocessor would display the next car in memory to be delivered and go through the same procedure again.

Figure 14:
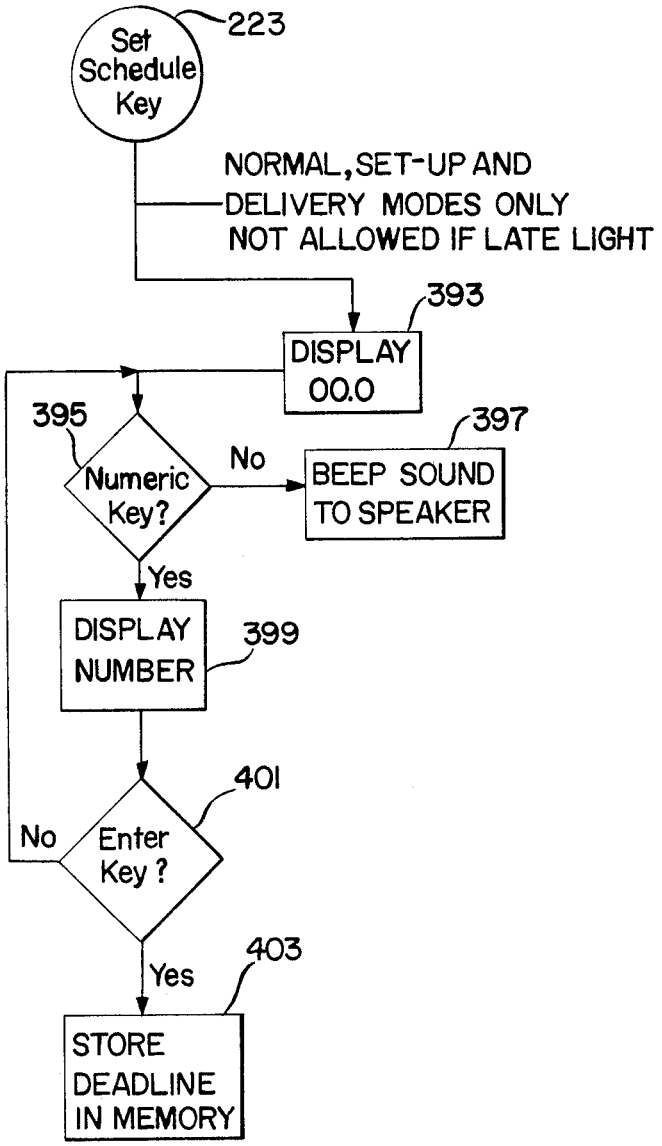
FIG. 14 is a flow chart illustrating the procedure executed when the 'set schedule' key on the operator control panel is depressed.

Referring now to FIG. 14, the process followed by the microprocessor in receiving a deadline schedule from the operator is illustrated. If a 'set schedule' key 223 is depressed during the normal, set-up or delivery mode, the microprocessor will take note of it. If the 'late' light is lit, the 'set schedule' key will not be permitted and the microprocessor will ignore it. Assuming that the 'late' light is not on and the microprocessor is in the normal, set-up or delivery mode, the microprocessor reacts to a 'set schedule' key depression by displaying a 0.00 time 393. It then waits for a numeric key depression 395 which will establish the new deadline. Any other key depression will generate a 'beep' sound to the speaker 397 without causing a change in the display. If numeric keys are depressed, the number corresponding to the key depression is displayed 399. In addition, the microprocessor looks for the 'enter' key depression 401. If no 'enter' key depression is received, it keeps looking for a numeric key depression. If an 'enter' key depression is received, the microprocessor stores the new deadline in memory 403.

Figure 15:
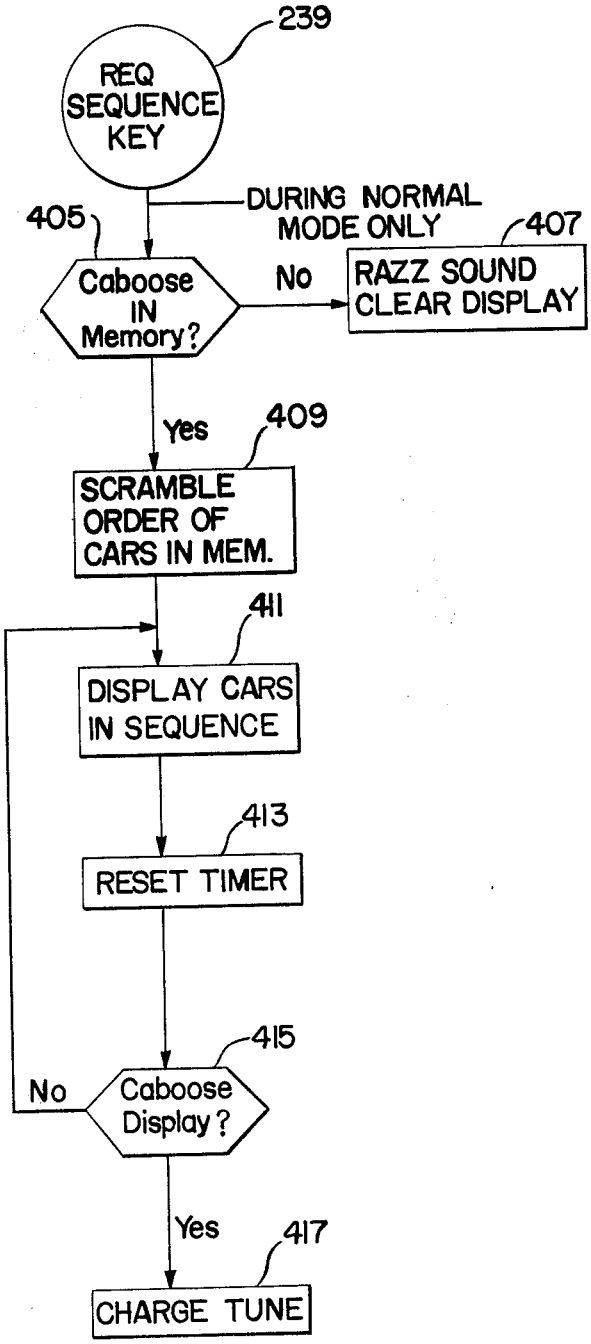
FIG. 15 is a flow chart illustrating the procedure executed when the 'request sequence' key on the operator control panel is depressed.

Referring now to FIG. 15, the 'request sequence' procedure followed by the microprocessor upon the depression of the 'request sequence' key 239 is shown. Depression of this key is recognized only during the normal mode of the microprocessor. Assuming that the microprocessor is in the normal mode, the 'request sequence' key depression 239 will cause the microprocessor to determine if a caboose indicia is in memory 405. If no caboose is in memory, then the microprocessor will generate a 'razz' sound to the speaker and clear the display 407. If a caboose indicia is in memory, it will scramble the order of the cars in memory 409. Then, it will display the new order in sequence 411, reset the timer 413, and, as soon as the caboose is displayed 415, it generates a "Charge" tune 417. Prior to the caboose display, it continues displaying the cars in the sequence.

What has been described is a toy track system wherein the operator skill in manipulating the cars of the train is tested and acknowledged by providing the operator an opportunity to assemble a dictated sequence of cars within a certain time frame or removing individual cars from the train in a dictated sequence within a certain time frame wherein the operator may program the order in sequence and time frame within which these functions are to be performed and the order and time frame within which certain accessory devices are activated. It should be understood, of course, that the foregoing disclosure relates to the preferred embodiments of the invention and that other modifications may be made therein without departing from the spirit and scope of the invention as set forth in the appended claims.

What is claimed is:

1. In a toy track system wherein a plurality of cars move under the control of an operator, improved operator involvement apparatus, comprising:

means attached to each of a plurality of cars on the track for uniquely identifying each car;

means for sensing the passage and identity of each car having an identifying means;

a keyboard means for providing keyboard signals;

microprocessor means having input and output channels, said microprocessor means being responsive to said sensing means and said keyboard signals through said input channels;

a plurality of light emitting diode means receiving signals from said microprocessor means through the output channels for indicating information to the operator;

a speaker means receiving signals from said microprocessor means through the output channels for indicating information to the operator;

a plurality of seven segment display elements receiving signals from said microprocessor means through the output channels for indicating information to the operator; and wherein said microprocessor means is programmed to scramble the order of the car identities stored in memory and display the new order sequentially upon a request from the keyboard.

2. In a toy track system wherein a plurality of cars move under the control of an operator, improved operator involvement apparatus, comprising:

means attached to each of a plurality of cars on the track for uniquely identifying each car;

means for sensing the passage and identity of each car having an identifying means;

a keyboard means for providing keyboard signals;

microprocessor means having input and output channels, said microprocessor means being responsive to said sensing means and said keyboard signals through said input channels;

a plurality of light emitting diode means receiving signals from said microprocessor means through the output channels for indicating information to the operator;

a speaker means receiving signals from said microprocessor means through the output channels for indicating information to the operator;

a plurality of seven segment display elements receiving signals from said microprocessor means through the output the output channels for indicating information to the operator; and wherein said microprocessor means is programmed to receive a time block from said keyboard means, store it in memory, and generate a signal to indicate that time has run out when the microprocessor clock is started by a key on the keyboard means.

3. In a toy track system wherein a plurality of cars move under the control of an operator, improved operator involvement apparatus, comprising:

means attached to each of a plurality of cars on the track for uniquely identifying each car;

means for sensing the passage and identity of each car having an identifying means;

a keyboard means for providing keyboard signals;

microprocessor means having input and output channels, said microprocessor means being responsive to said sensing means and said keyboard signals through said input channels;

a plurality of light emitting diode means receiving signals from said microprocessor means through the output channels for indicating information to the operator;

a speaker means receiving signals from said microprocessor means through the output channels for indicating information to the operator;

a plurality of seven segment display elements receiving signals from said microprocessor means through the output channels for indicating information to the operator; and wherein said microprocessor means is programmed to indicate a sequence of car identities on the display elements in the order in which such cars are to be removed from the train, and determine the absence of each car from the train as indicated within the operator entered time schedule.

4. In a toy track system wherein a plurality of cars move under the control of an operator, improved operator involvement apparatus, comprising:

means attached to each of a plurality of cars on the track for uniquely identifying each car;

means for sensing the passage and identity of each car having an identifying means;

a keyboard means for providing keyboard signals;

microprocessor means having input and output channels, said microprocessor means being responsive to said sensing means and said keyboard signals through said input channels;

a plurality of light emitting diode means receiving signals from said microprocessor means through the output channels for indicating information to the operator;

a speaker means receiving signals from said microprocessor means through the output channels for indicating information to the operator;

a plurality of seven segment display elements receiving signals from said microprocessor means through the output channels for indicating information to the operator; and wherein said microprocessor means is programmed to indicate a sequence of car identities on the display elements in the order in which such cars are to be assembled into a train, and determine the correct assembly of the train in the sequence indicated within the operator entered time schedule.

* * * * *